United States Patent [19]

Diefenbach

[11] 4,443,201

[45] Apr. 17, 1984

[54] SHAPE ASSOCIATION SOUND-EMITTING TOY

[76] Inventor: Berndt Diefenbach, Würmstrasse 8, Percha D-8136, Fed. Rep. of Germany

[21] Appl. No.: 368,474

[22] Filed: Apr. 14, 1982

[51] Int. Cl.[3] ..... G09B 1/06; A63H 5/00

[52] U.S. Cl. ..... 434/259; 46/178

[58] Field of Search ..... 46/178, 187, 179, 180, 46/174, 175 R; 434/259

[56] References Cited

U.S. PATENT DOCUMENTS

| | | | |
|---|---|---|---|
| 455,671 | 7/1891 | Sellers | 46/178 |
| 2,558,237 | 6/1951 | Cohn et al. | 46/187 X |
| 4,348,191 | 9/1982 | Lipsitz et al. | 434/259 X |

FOREIGN PATENT DOCUMENTS

| | | | |
|---|---|---|---|
| 500700 | 11/1954 | Italy | 46/178 |

*Primary Examiner*—Mickey Yu

*Attorney, Agent, or Firm*—Flynn, Thiel, Boutell & Tanis

[57] ABSTRACT

A sound-emitting toy has a substantially vertical guide channel with a tight seal at one end, in which is movably supported a piston which confirms peripherally to the cross-sectional shape of the guide channel and has a vent hole which provides a flow connection through the piston. In the flow area of the vent hole is arranged a device which produces a sound upon movement of the piston due to the force of gravity toward the seal and in response to the resulting flow of displaced air. Pistons of dissimilar cross-sectional shapes are to be associated with guide channels having matching cross-sectional shapes by the player.

4 Claims, 5 Drawing Figures

SHAPE ASSOCIATION SOUND-EMITTING TOY

FIELD OF THE INVENTION

This invention relates to a sound-emitting toy and, more particularly, to a sound-emitting toy having a substantially vertical guide channel which has a tight seal at one end and in which is movable supported a piston which comforms to the cross-sectional shape of the guide channel and has a vent hole which provides a flow connection through the piston, in the flow area of which vent hole is arranged a device which produces sound upon movement of the piston toward the seal and in response to the resulting flow of the displaced air.

BACKGROUND OF THE INVENTION

A sound-emitting toy of the above-mentioned type is known from U.S. Pat. No. 3,896,584. It consists of a toy chicken, the legs of which serve as rods for pistons arranged in vertical chambers inside of the chicken body. Each chamber is defined by a guide channel which is closed off at its upper end. A piston is arranged at the upper end of each leg. A spiral spring is provided between the upper side of the piston and the closed upper end of the guide channel, which spring normally urges the piston and thus the respective chicken leg toward its lower end position. A wall which has through openings for air and for the piston rod forms the lower end of the chamber and is mounted to the lower end of the channel in such a manner that it can absorb impact forces which are applied to it by the piston as the piston reaches its lower end position.

Sounds are produced with this conventional sound-emitting toy by moving one or both chicken legs upwardly. Air which is trapped in the chamber above the piston is moved out through a vent hole upon moving up the associated leg and thus the piston. This air thereby passes a device which can produce a sound and causes such device to emit the sound. The simplest operation of the conventional sound-emitting toy is done by pressing the standing animal down onto a surface so that the legs move into the body. Sound is emitted during this pressing down of the body. The restoring springs which are provided in the chambers then move the legs outwardly again and return the animal to its original height.

In the conventional sound-emitting toy, sound-emitting parts only have the purpose of imitating in a toy animal which is moved by the user the squawking noises which can often be heard during the walking movement of real animals.

A basic purpose of the present invention is to produce a simply designed sound-emitting toy in which the proper association and assembly of the individual parts thereof is to be effected by the user, an acoustical indication being possible in the case of success.

SUMMARY OF THE INVENTION

This purpose is attained inventively by providing a piston which produces a sound by sliding downwardly within a guide channel due to the force of gravity and which has sufficient weight so that at least the minimum rate of air flow necessary to produce a sound is achieved through a vent hole in the piston.

It is intended according to the invention that the piston within the guide channel drop downwardly due to its own weight. If the piston is to slide downwardly on an air pressure cushion, then the lower end of the guide channel should be closed off tightly. The air which is entrapped in the cylinder is thus forced to escape only through the piston vent hole. It thereby passes the device which produces sound and effects sound emission. Sound is produced only so long as air moves through the vent hole, and if no additional air is supplied to the chamber defined by the channel and piston, sound will be produced only so long as the piston is descending.

The piston, of course, can also slide downwardly in a guide channel which is tightly closed off at its upper end. Air then flows into the chamber through the vent hole, which also causes a sound to be produced. It is advantageous for the functioning of the sound-emitting toy if the piston is well sealed with respect to the walls of the guide channel but is still supported so as to be easily movable therein.

An acoustic indication of successful assembly through the production of a sound will, however, only occur if the user has caused a tight seal, for example at the lower end of the guide channel, and was also capable of properly inserting the piston into the guide channel. It is important for the sound production that a pressure or vacuum is present within the chamber which is defined by the channel and piston, which pressure or vacuum forces the flow medium, preferably air, to flow through the vent hole and to initiate operation of the sound device. This will only be the case if the minimum air flow necessary for sound production is achieved. The piston and sound device assembly must therefore have a minimum weight which is sufficient to produce this air flow. If this assembly is too light, it may descend without emitting a sound. If this assembly is too heavy, the piston may pass through the guide channel too quickly so that sound is emitted for only a relatively short period of time.

In addition to the acoustic indication of successful assembly, there can also be an optical indication if the guide channel is advantageously made of a transparent material.

A very simple construction is obtained in a further favorable development if the closure is formed by a support surface for the guide channel. It is hereby sufficient for the user to correctly position the guide channel on the support surface after which the piston can be introduced and a sound produced. It is also possible to provide a regular or irregular projection or recess on the support surface, the shape of which corresponds to the shape of the end of the guide channel. A tight closure of the channel is thus obtained only if assembly is done correctly.

A simple closure of the guide channel is obtained advantageously if an easily releasable lid is provided. The sound-emitting toy works also if at least one end of the guide channel is tightly closed. The air stream which is necessary for the sound production can be adjusted and the sound which travels through the open end of the guide channel to the outside can be heard. To the degree to which the loudness of the produced sound is to be reduced, it is possible to also close the second end of the guide channel. An easily releasable lid offers the advantage that a piston which has arrived at the lower end of the channel can be removed in a simple manner by opening the lid. However, it is also conceivable to provide the wall of the guide channel with a closure, for example in the form of a flap or door. In this case, it is possible to remove the piston laterally from the guide channel.

The guide channel is constructed in a favorable manner in the form of a pipe with a cross-sectional shape which remains substantially constant throughout its length. In particular, a circle, a rectangular, a cross, a coil, a triangle or an ellipse is possible. Of course, it is also possible to use cross sections in the shape of a fish or an animal. Providing various cross-sectional shapes for the guide channels can allow the sound-emitting toy to function as a puzzle. The user, for example a child, must associate the differently shaped pistons with the corresponding guide channel in order to introduce the pistons into the guide channels for the purpose of sound production.

A very simple form of closure is obtained if same is constructed as a base for the guide channel. The base can hereby have a recess or projection which conforms to the shape of the guide channel and with which the guide channel can be engaged for the purpose of effecting closure of its end. The sides of the recess are supposed to correspond in shape in this case with the shape of the guide channel. In the case of a base with a projection which conforms to the inside contour of the guide channel, it is possible during use of the sound-emitting toy to sealingly place the guide channel thereover.

If one arranges several guide channels side-by-side, then the user can simultaneously or successively introduce the pistons into the guide channels. If the respective pistons have devices which produce different sounds, then the sound-emitting toy becomes, in effect, a type of instrument. If the guide channels are at the same time transparent then, due to the visible downwardly moving piston and aside from the acoustic indication of success, there results an optically active device. By regulating the sealing of the closure the length of each sound can be influenced. Where, during sliding down of the piston, the closure is completely absent, no sound is produced because an air stream is no longer produced through the vent hole.

If a compressed-air supply is connected to the guide channel, then it is possible to keep the piston suspended by maintaining the air pressure cushion therebelow, causing continuous sound emission. Of course, it is also possible by increasing or reducing the air supply to cause the piston to rise or to descend. The compressed-air supply can be a compressed-air storage device, a pump, an air balloon or the like.

The guide channel or guide channels can, if desired, be curved. They can be designed, for example, spiral-shaped which, during sliding down of the piston, results in a better visual effect.

BRIEF DESCRIPTION OF THE DRAWINGS

Several exemplary embodiments of the invention will be described hereinafter in connection with the drawings.

In the drawings.

DETAILED DESCRIPTION

Figure 1:
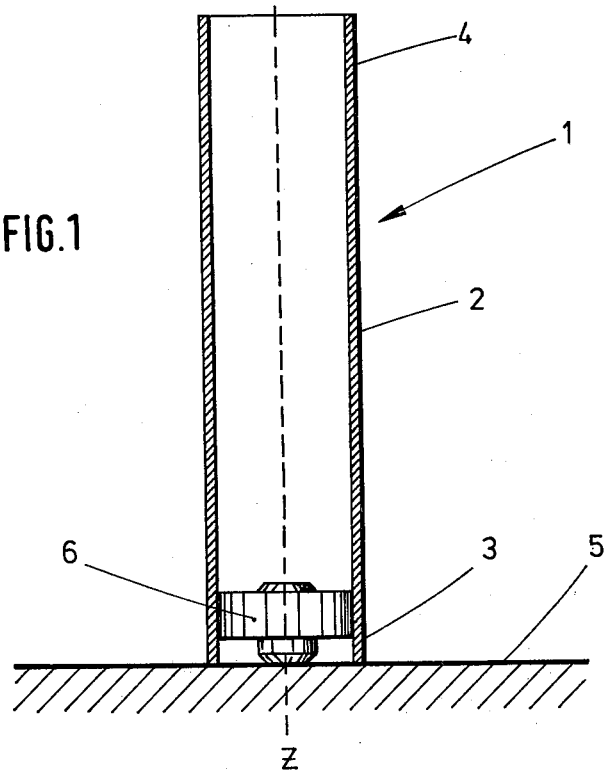
FIG. 1 is a central sectional side view of a first embodiment of a toy embodying the invention.

FIG. 1 illustrates a first embodiment of a sound-emitting toy 1. It has a vertical guide channel 2 which is a pipe with a circular cross section. The guide channel 2 is cut off evenly at both ends 3 and 4 along planes which are normal to its axis. The guide channel 2 is supported in an upright manner on a flat support surface 5. Thus, a tight seal is obtained between the lower end 3 of the guide channel 2 and the support surface 5.

A piston 6, which in the present case is circular, is arranged movably in the guide channel 2. The piston 6 conforms in peripheral shape to the cross-sectional shape of the interior of the guide channel 2, and is illustrated in detail in FIG. 2. The illustrated piston 6 thus has the shape of substantially a cylinder, the axis z of which coincides in the arrangement of FIG. 1 with the cylinder axis Z of the guide channel 2. The piston has, concentric with respect to the axis z, a vent hole 7 which leads from the lower piston side 8 to the upper piston side 9 and thus creates a flow connection between these two sides. A sound-emitting device 10, for example a pipe or a reed device, is arranged in the vent hole, in the present case in the center thereof. When a flow medium such as air is moved through the vent hole, the device 10 will produce a sound. The illustrated device 10 produces a sound when an air flow is produced therethrough in either direction. It is also conceivable to use a device 10 which produces a sound in response to an air flow in only one direction.

The outside diameter of the piston 6 conforms to the inside diameter of the guide channel 2 in such a manner that the piston 6 can slide freely therein. To operate the inventive sound-emitting toy, the piston 6 is introduced into the guide channel 2 through the open upper end 4 thereof. The guide channel 2 has a tight closure or seal at its lower end 3. In the case of the exemplary embodiment of FIG. 1, the seal is achieved by the stable arrangement of the guide channel 2 on the support surface 5. The piston 6 then slides downwardly within the guide channel and compresses with the help of its weight the air which is entrapped below it in the guide channel 2. This trapped air moves through the vent hole 7 of the piston 6 and out of the cylindrical chamber defined by the piston 6 and channel 2. As this air passes the sound-producing device 10, it causes the sound-producing device 10 to become active and to emit a sound. The sound is produced so long as the air flows through the vent hole 7. In the exemplary embodiment of FIG. 1, this means that sound is produced so long as the piston slides downwardly in response to the force of gravity. The weight of the assembly which consists of the sound-producing device 10 and the piston 6 is selected so that at least the minimum rate of air flow required for the device 10 to produce a sound is achieved in the vent hole. If the assembly is too light, the piston will slide downwardly within the guide channel 2 but no sound will be emitted. If the assembly is heavier than necessary, a sound will be produced, but for a shorter period of time.

Figure 2:
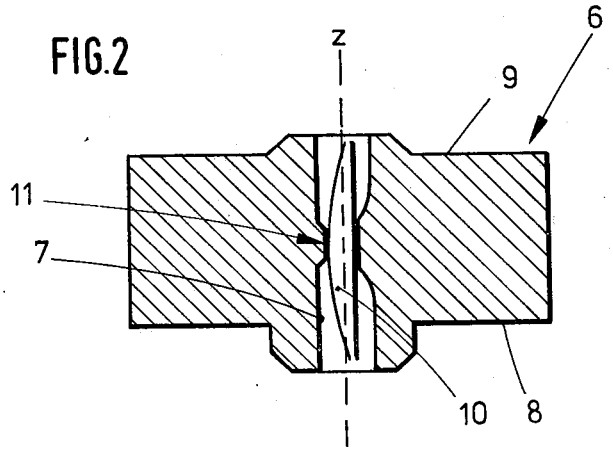
FIG. 2 is a central sectional side view of a piston which is a component of the embodiment of FIG. 1.

FIG. 2 illustrates the device 10 arranged symmetrically within the vent hole 7. The vent hole 7 has a clamping point for the device 10 at the point 11. The clamping point 11 defines, together with the sound-producing device 10, a flow restriction in the vent hole 7.

The remaining exemplary embodiments are generally similar in design to the exemplary embodiment of FIGS. 1 and 2. Accordingly, only the differences therebetween will be discussed hereinafter, and similar parts are provided with the similar reference numerals.

Figure 3:
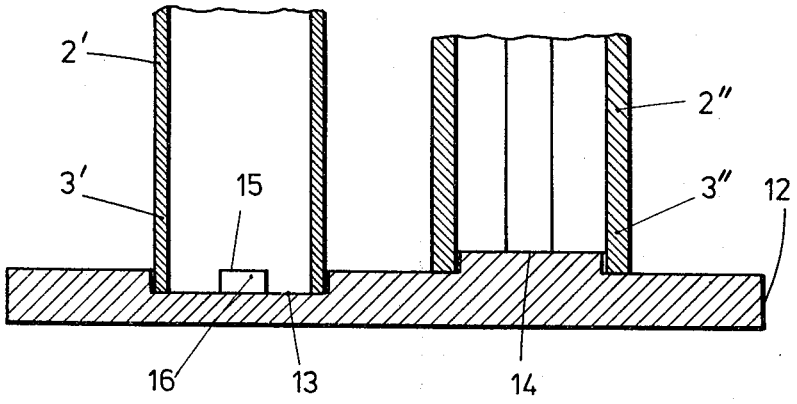
FIG. 3 is a central sectional side view of a second embodiment of the toy of FIG. 1 which has two guide channels.

The exemplary embodiment according to FIG. 3 has two guide channels 2' and 2'' arranged side-by-side. The lower ends thereof are closed by a common flat base plate 12. The left guide channel 2' has a square cross section, and the right guide channel 2'' has a cross section in the shape of a cross with legs of equal length, whereby the two channels are of noncompatible cross sections and respectively slidably receive pistons of conforming shape. The left guide channel 2' has its lower end 3' inserted into a recess 13 which is shaped to conform to the outer circumference of the guide channel 2' in such a manner that the channel 2' can be easily slidingly inserted into the recess 13 by a user. The sealing between the guide channel 2' and the base plate 12 can either occur on the bottom or the sides of the recess 13 or at both places. The same is true for the cross-shaped guide channel 2'' of FIG. 3. An upward projection 14 which is cross-shaped in a top view is provided for receiving the guide channel 2'', which projection preferably projects about 5 mm above the surface of the base plate 12.

A recess 15 is provided in the left guide channel 2' of the exemplary embodiment of FIG. 3 at the lower end 3' thereof, which recess is cooperable with a key 16. The purpose of the recess and key is to permit full insertion of the square guide channel 2' in only one of its four possible positions. This means that the sound-emitting toy can only operate properly if the guide channel 2' is first inserted correctly in the recess 13.

A similar challenge for the user can be achieved with the cross-shaped guide channel 2'' of the exemplary embodiment in FIG. 3 if the legs of the cross are dimensioned with different lengths or an asymmetrical cross shape is chosen.

Many other geometric cross-sectional shapes can be used for the guide channels instead of the illustrated cross-sectional shapes. The shape of a coil, a triangle, an ellipse, a contour, or an animal are suggested as possibilities.

Figure 4:
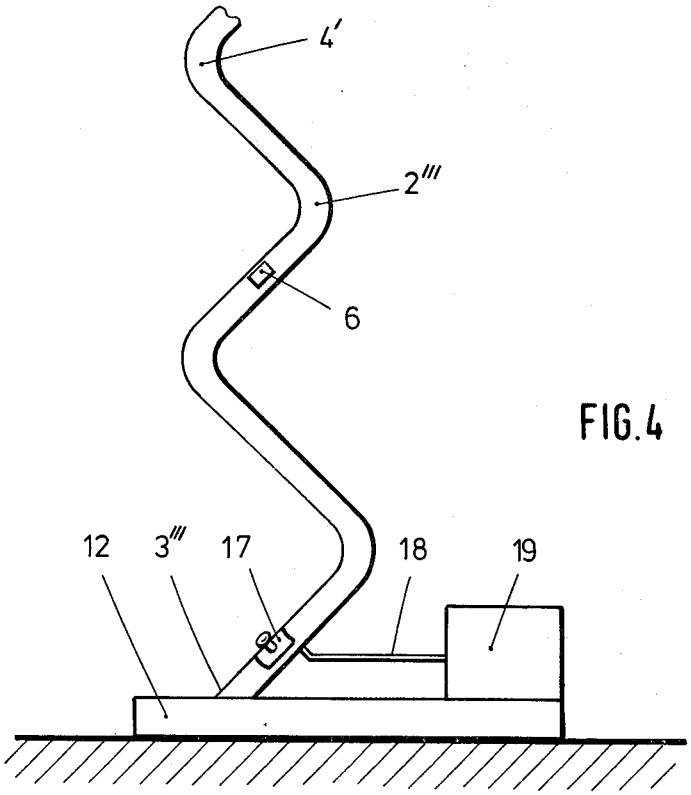
FIG. 4 is a side view of a third embodiment of the toy of FIG. 1.

In the exemplary embodiment of FIG. 4, the guide channel 2''' is designed in the form of a spiral. Its cross section is circular, analogous to the exemplary embodiment of FIG. 1. In the area of its lower end 3''', a removal flap or door 17 is provided in the wall of the guide channel 2''', which flap can be closed in an airtight manner and can be opened to remove a piston 6 from the lower end of the channel 2'''.

A compressed-air supply line 18 connects a motor driven air pump 19 to the lower end 3''' of the guide channel 2'''. Compressed air can be introduced into the inside of the guide channel 2''' with the help of the pump 19. If the pump 19 feeds in as much air per unit time as is escaping through the vent hole in the piston 6, then downward movement of the piston 6 which is in the guide channel 2''' will be suspended by the piston 6 will still produce the desired sound. If the air flow rate from the pump 19 is increased, the piston 6 will rise within the guide channel 2''', and if the air flow rate is reduced, the piston will descend.

The channel 2''' is preferably made of a transparent material, and the spiral shape imparts an additional movement which the eye can follow to the piston as it moves downwardly.

Figure 5:
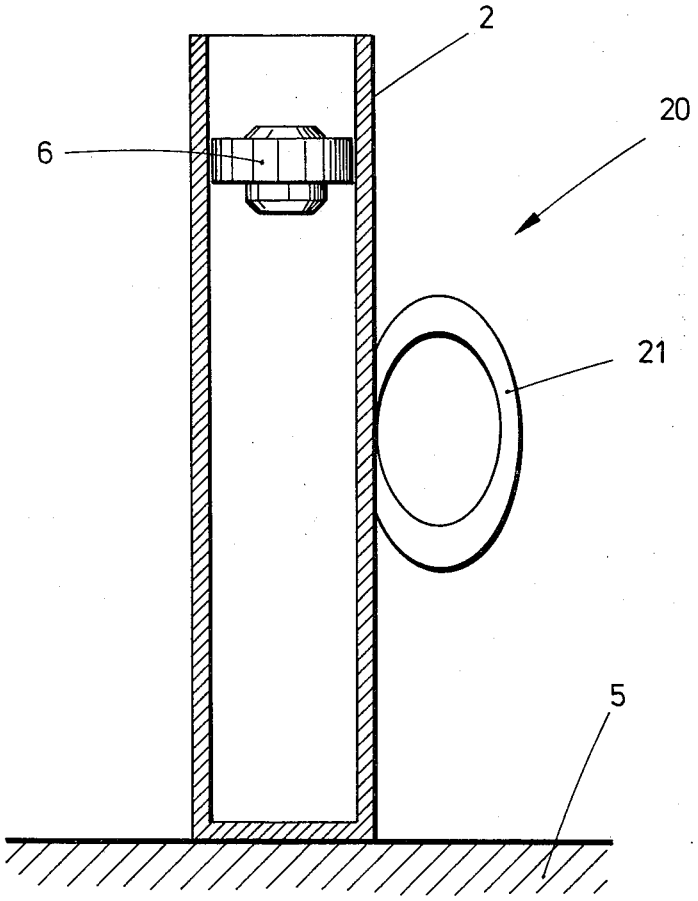
FIG. 5 is a side view of a fourth embodiment of the toy of FIG. 1.

FIG. 5 illustrates another exemplary embodiment of a sound-emitting toy 20. It has a cylindral guide channel 2 and a piston 6 which conforms in shape thereto, as is known from the exemplary embodiment of FIGS. 1 and 2. The guide channel 2, however, is permanently closed off at its lower end. This means that the cylinder and the closure wall at its lower end are manufactured in one piece. FIG. 5 illustrates the piston 6 just after it has been introduced through the upper opening of the guide channel 2. It is supported on a compressed-air cushion, since air is trapped in the cylinder chamber which is closed off by the piston, and the air can escape only through the vent hole within the piston, allowing the piston to move downwardly. A sound is thereby produced, as already described. When the piston arrives at the lower end of the channel 2, the sound production stops.

If one then inverts the sound-emitting toy with the help of a handle 21 provided on the channel 2 until the cylindrical guide channel 2 is again approximately vertical, then the piston 6 will descend toward the end 4 and emit during its downward movement an audible sound. The speed control of the piston 6 in this case is effected by the low pressure which is produced in the channel above the piston, the piston sliding downwardly at a speed determined by the rate at which air flows through the vent hole in the piston to the inside of the chamber which is defined by the cylinder and piston.

The invention is not limited to the illustrated exemplary embodiments. Thus, it is possible to introduce two or more pistons, one behind the other, into a guide channel. Several guide channels can advantageously be bunched together in order to form an optically interesting device. The level of the sound and the duration of the sound can be influenced by variations in the air supply or by regulating the degree to which the channel is sealed.

The guide channels of each embodiment are preferably of a length which greatly exceeds the piston height to create a substantial vertical distance for generating the sound, and are preferably manufactured of a transparent material to produce an optical effect. They can, of course, also be made of a nontransparent or semitransparent material.

It is also possible to equip the projection 14 (FIG. 3) with a sloped surface on the upper side thereof. Then, when a piston has arrived at the lower end of the channel and is to be removed therefrom, it is sufficient to lift the guide channel and, due to the absence of lateral support, the piston will then slide away to the side on the sloped surface and is thus, so to speak, ejected.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A sound-emitting toy, comprising in combination:

a support base;

first and second vertically elongated pipes positioned on and projecting vertically upwardly from said base in sidewardly spaced relationship, said pipes being of substantial vertical height, and said vertical height being several times greater than the horizontal cross-sectional dimension of the pipes;

each of said first and second pipes respectively having first and second internal guide channels extending vertically thereof and each having a substantially constant cross-sectional shape throughout its respective length, each said guide channel when mounted on said base having the lower end thereof closed;

said first and second channels having cross-sectional shapes which are dissimilar and noncompatible with one another;

a first piston having a cross-sectional shape which conforms solely to the shape of said first channel so as to be slidably but snugly positionable within said first channel so as to slidably move axially downwardly therealong due to the urging of gravity;

a second piston having a cross-sectional shape which conforms solely to the shape of said second channel so as to be slidably but snugly positionable with said second channel so as to slidably move axially downwardly therealong due to the urging of gravity;

each of said first and second pistons having a height which is only a small fraction of the vertical height of its respective pipe; and each of said first and second pistons having an opening extending axially therethrough and a sound-emitting means positioned within said opening for generating a sound in response to flow of air therethrough as said piston slidably moves downwardly within its respective channel due to the force of gravity.

2. A toy according to claim 1, wherein the first and second pipes are each removably positionable on the base and have the channels thereof extending therethrough so that the open lower end of the channels are closed by the base, first means associated with the base and cooperating with the lower end of said first pipe for supporting said first pipe in an upright position while sealingly closing off the lower end of said first channel, and second means on said base and cooperating with said second pipe for supporting said second pipe in an upright position while sealingly closing off the lower end of said second channel, said first and second means having configurations which are respectively compatible solely with said first and second pipes.

3. A toy according to claim 2, wherein the pistons are removable from the respective pipes, and wherein the upper ends of the channels are open so that the individual pistons can be selectively manually positioned adjacent and slidably axially inserted into the open upper end of the respective channel.

4. A toy according to claim 2, wherein each of said first and second means cooperates with the respective pipe for creating a telescopic cooperation with the lower end thereof when the respective pipe is removably positioned on the base in an upright position.

* * * * *

UNITED STATES PATENT AND TRADEMARK OFFICE

CERTIFICATE OF CORRECTION

PATENT NO. : 4,443,201

DATED : April 17, 1984

INVENTOR(S) : Berndt DIEFENBACH

It is certified that error appears in the above-identified patent and that said Letters Patent is hereby corrected as shown below:

Column 7, line 18; change "with" to ---within---.

Signed and Sealed this

Fourth Day of September 1984

[SEAL]

*Attest:*

GERALD J. MOSSINGHOFF

*Attesting Officer*

*Commissioner of Patents and Trademarks*